US006669747B2

(12) United States Patent
Salmon

(10) Patent No.: US 6,669,747 B2
(45) Date of Patent: Dec. 30, 2003

(54) GRINDING WHEEL WITH TITANIUM ALUMINUM NITRIDE AND HARD LUBRICANT COATINGS

(75) Inventor: Stuart C. Salmon, Perrysburg, OH (US)

(73) Assignee: Master Chemical Corporation, Perrysburg, OH (US)

( * ) Notice: Subject to any disclaimer, the term of this patent is extended or adjusted under 35 U.S.C. 154(b) by 0 days.

(21) Appl. No.: 10/076,730

(22) Filed: Feb. 15, 2002

(65) Prior Publication Data

US 2003/0154658 A1 Aug. 21, 2003

(51) Int. Cl.[7] ..... B24D 3/00; B24D 3/04; B24D 5/00; B24D 7/00

(52) U.S. Cl. ..... 51/307; 51/293; 51/297

(58) Field of Search ..... 51/307, 295, 308, 51/309, 297, 293

(56) References Cited

U.S. PATENT DOCUMENTS 5,139,537 A 8/1992 Julien 5,376,444 A * 12/1994 Grotepass et al. ..... 428/336

5,833,021 A * 11/1998 Mensa-Wilmot et al. ... 175/433

* cited by examiner

*Primary Examiner*—Michael Marcheschi

(74) *Attorney, Agent, or Firm*—Brinks Hofer Gilson & Lione

(57) ABSTRACT

A grinding wheel according to the present invention includes cubic boron nitride (cBN) or other abrasive particles such as diamond secured to a substrate by an electroplated, electroless plated or brazed layer of nickel, chrome or nickel or chrome based alloy, a first antioxidation layer of, for example, vapor deposited titanium aluminum nitride (TiAlN) and a second hard lubricant layer of, for example, vapor deposited molybdenum disulfide ($MoS_2$), diamond graphite, tungsten carbide carbon, carbon nitride, titanium carbide carbon or titanium carbon nitride. The hard lubricant layer acts as a release agent and lubricant which reduces clogging of the wheel by lowering adhesion and facilitating the release of ground material from the wheel thereby providing improved grinding performance.

25 Claims, 3 Drawing Sheets

FIG.1
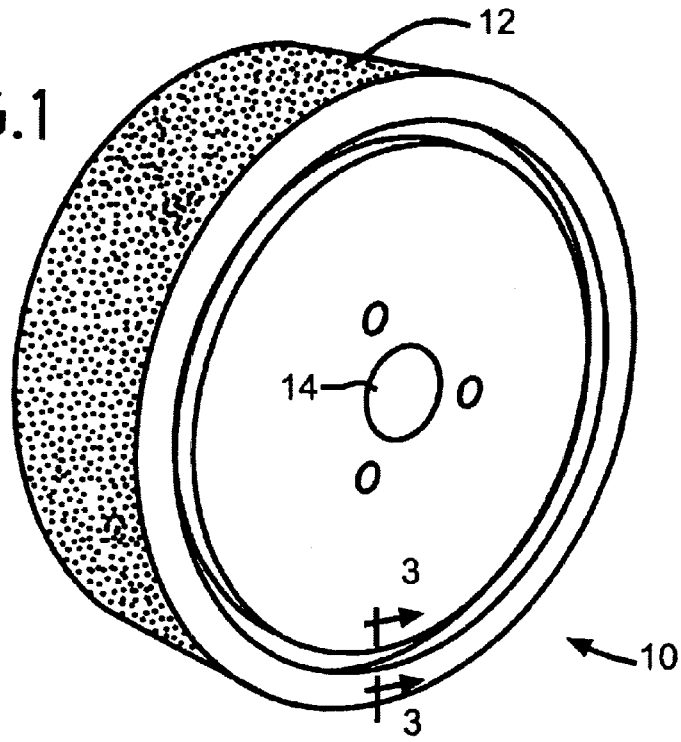
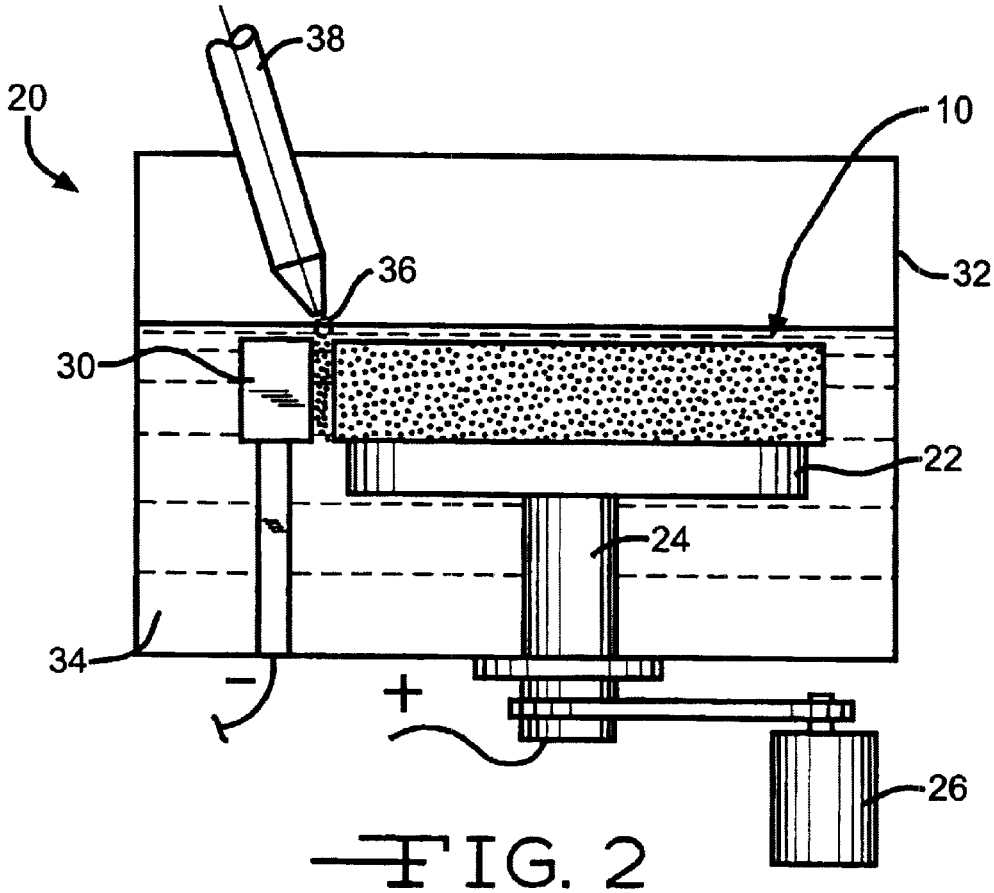
FIG. 2

GRINDING WHEEL WITH TITANIUM ALUMINUM NITRIDE AND HARD LUBRICANT COATINGS

BACKGROUND OF THE INVENTION

The invention relates generally to grinding wheels and more particularly to an improved super abrasive grinding wheel having titanium aluminum nitride and hard lubricant coatings.

The performance of grinding wheels is a slowly but constantly evolving technology. Because of the pervasive use of grinding in numerous manufacturing processes, there has been a constant incentive to increase grinding wheel performance the primary criteria of which is enhanced service life. A significant increase in service life over conventional aluminum oxide grinding wheels was achieved by the incorporation of the first super abrasive, diamond, as diamond fragments or particles into the grinding wheel or on the peripheral surface of the grinding wheel. Grinding wheels utilizing diamond, however, were not successfully used with steels and other ferrous alloys because of the tendency of diamond to react with and be absorbed into such materials at the temperatures and pressures existing at the grinding wheel/material interface. This shortcoming has significantly reduced the utilization of such grinding wheels when grinding ferrous materials.

More recently, a manmade super abrasive, cubic boron nitride (cBN), has not only provided improved service life but also functioned with a wider variety of materials, particularly steels, hardened steels, stainless steels, and nickel and cobalt based super alloys. Cubic boron nitride grinding wheels typically perform better than diamond materials with steel and other ferrous alloys.

Cubic boron nitride grinding wheels typically comprise a metal wheel or core with a periphery onto which the cubic boron nitride particles or fragments are secured by electroplating, electroless plating or brazing.

U.S. Pat. No. 5,139,537 discloses the coating of such grinding wheels with titanium nitride. Such a coating is said to greatly strengthen the adherence of the cBN particles to the grinding wheel.

As noted above, however, due to the evolutionary improvements in grinding wheel technology, further performance enhancements are anticipated and the present invention as directed to a grinding wheel having improved performance characteristics.

BRIEF SUMMARY OF THE INVENTION

A grinding wheel according to the present invention includes cubic boron nitride (cBN) or other abrasive particles such as diamond secured to a substrate by an electroplated, electroless plated or brazed layer of nickel, chrome or nickel or chrome based alloy, a first antioxidation layer of, for example, vapor deposited titanium aluminum nitride (TiAlN) and a second hard lubricant layer of, for example, vapor deposited molybdenum disulfide ($MoS_2$), diamond graphite, tungsten carbide carbon, carbon nitride, titanium carbide carbon or titanium carbon nitride. The hard lubricant layer acts as a release agent and lubricant which reduces clogging of the wheel by lowering adhesion and facilitating the release of ground material from the wheel thereby providing improved grinding performance.

Thus it is an object of the present invention to provide a grinding wheel having grinding media coated with a first antioxidation layer and a second hard lubricant layer.

It is a further object of the present invention to provide a grinding wheel having grinding media covered with a first layer of vapor deposited titanium aluminum nitride and a second layer of a vapor deposited hard lubricant such as molybdenum disulfide, diamond graphite, tungsten carbide carbon, carbon nitride, titanium carbide carbon or titanium carbon nitride.

It is a still further object of the present invention to provide a grinding wheel having cubic boron nitride abrasive particles coated by layers of titanium aluminum nitride and molybdenum disulfide, diamond graphite, tungsten carbide carbon, carbon nitride, titanium carbide carbon or titanium carbon nitride.

It is a still further object of the present invention to provide a grinding wheel having electroplated, electroless plated or brazed nickel, chrome or nickel or chrome based alloys securing cubic boron nitride abrasive particles which are coated by a first antioxidizing layer of titanium aluminum nitride and a second hard lubricant layer of molybdenum disulfide, diamond graphite or tungsten carbide carbon, carbon nitride, titanium carbide carbon or titanium carbon nitride.

Further objects and advantages of the present invention will become apparent by reference to the following description and appended drawings wherein like reference numbers refer to the same component, element or feature.

BRIEF DESCRIPTION OF THE DRAWINGS

FIG. 1 is a perspective view of a grinding wheel according to the present invention;

FIG. 2 is schematic representation of an electroplating apparatus which may be utilized during the manufacture of a grinding wheel according to the present invention;

DETAILED DESCRIPTION OF THE PREFERRED EMBODIMENT OF THE INVENTION

Figure 3:
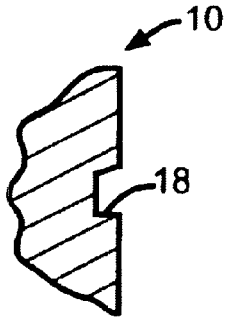
FIG. 3 is a fragmentary, sectional view of a grinding wheel according to the present invention taken along line 3—3 of FIG. 1.

Referring now to FIGS. 1 and 3, a grinding wheel according to the present invention is illustrated and generally designated by the reference number 10. A typical grinding wheel 10 is circular and defines a diameter of, for example, 1 to 24 inches (2.54 cm to 61 cm) and defines a width, typically on a smaller scale of 0.5 to 6 inches (1.27 cm to 15.2 cm). Larger or smaller grinding wheels 10 are, of course, wholly suitable for use with the present invention. Although illustrated as having a flat outer peripheral surface 12, more frequently, commercial and industrial grinding wheels will define a particular profile having larger diameter regions and smaller diameter regions merging with oblique, stepped, flat or curved regions which create corresponding shapes in a workpiece. The flat outer peripheral surface 12 is presented solely for purposes of illustration and explanation.

The grinding wheel 10 typically includes a centrally disposed bore 14 through which an arbor (not illustrated) may be disposed and upon which the grinding wheel 10 may be mounted. As illustrated in FIG. 3, the grinding wheel 10 typically includes a circumferential clocking or indicating ring or groove 18 generally proximate to the outer peripheral surface 12 which is utilized to center the grinding wheel 10 on the arbor. Centering of the grinding wheel 10 utilizing the clocking groove 18 enhances the concentricity achieved on the arbor when the grinding wheel 10 is rotated due to the proximity of the clocking groove 18 to the outer peripheral surface 12.

Figure 6:
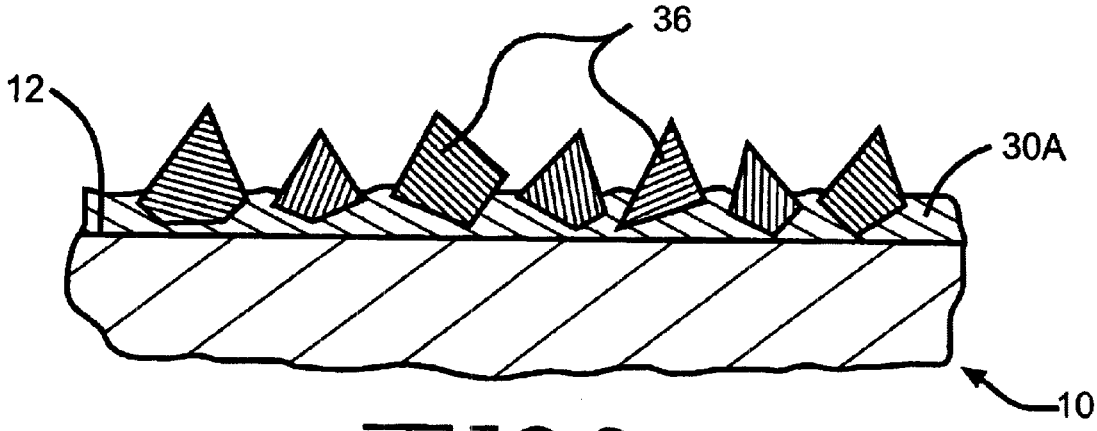
FIG. 6 is a greatly enlarged, fragmentary, sectional view of abrasive particles secured to a grinding wheel surface according to the present invention.

Referring now to FIGS. 2 and 6, manufacture of the grinding wheel 10 according to the present invention comprises three distinct steps after the blank for the grinding wheel 10 has been manufactured. The blank for the grinding wheel 10 may be solid metal, for example, steel, or a metal composite which is machined to its final shape. The grinding wheel 10 may also be net formed powdered metal or a formed and sintered part. FIG. 2 schematically illustrates an electroplating machine 20 wherein the grinding wheel 10 is placed horizontally on a rotatable circular platform 22 attached to a rotating spindle 24 which is driven through any convenient means by a motor such as an electric motor 26. Adjacent the periphery of the grinding wheel 10 is an electrode 30 of, for example, nickel or other metal alloy having similar electrical and physical characteristics, which is supplied with a direct current electrical charge from an external source (not illustrated). The grinding wheel 10 and the nickel electrode 30 are oppositely charged.

The grinding wheel 10, the platform 22, the spindle 24 and the nickel electrode 30 are disposed within an electroplating tank 32 which is filled with a suitable electroplating liquid 34. Positioned to provide a controlled flow of abrasive particles such as cubic boron nitride (cBN) particles 36 or other abrasive particles such as diamond particles, is a nozzle 38. FIG. 6 illustrates, in a greatly enlarged view, that operated for a sufficient time, the nickel or other material migrates from the electrode 30 to the outer peripheral surface 12 of the grinding wheel 10 to form a layer of electroplated nickel 30A and secures a plurality of cubic boron nitride or other abrasive particles 36 to the surface 12 to provide an abrasive or grinding surface on the grinding wheel 10. This process and its parameters are well known in the art, obviating the need to describe operating conditions and cycle times. It should be understood that other processes for attaching the abrasive particles such as electroless plating and brazing are also suitable and within the scope of this invention.

Figure 4:
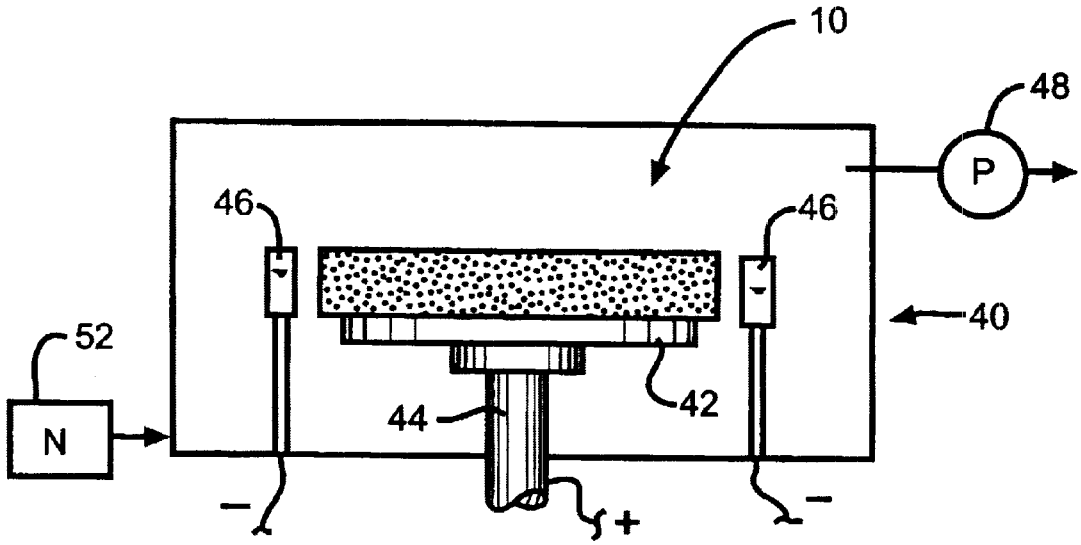
FIG. 4 is a schematic representation of a physical vapor deposition chamber which may be utilized during the manufacture of a grinding wheel according to the present invention.
Figure 7:
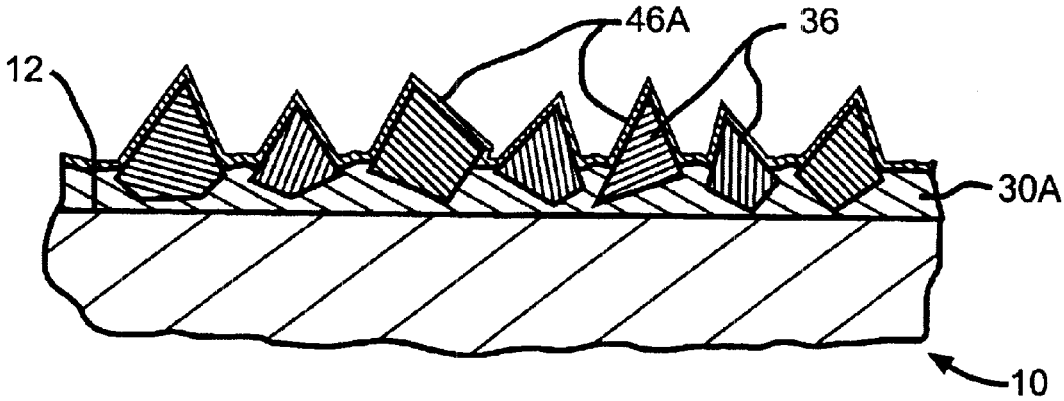
FIG. 7 is a greatly enlarged, fragmentary, sectional view of a grinding wheel having abrasive particles and a titanium aluminum nitride layer according to the present invention.

Referring now to FIGS. 4 and 7, a physical vapor deposition chamber 40 is illustrated. The grinding wheel 10, with its outer peripheral surface 12 now including a plurality of abrasive particles 36 such as cubic boron nitride particles adhered by, for example, electroplated nickel 30A, is placed upon a rotatable platform 42 which is rotated by a spindle 44 and suitable mechanical equipment (not illustrated) external to the deposition chamber 40. Also disposed within the interior of the physical vapor deposition chamber 40 are one or preferably two target cathodes 46 which are electrically charged by a common source of electricity. The target cathodes 46 are preferably an alloy of between 50 and 55% aluminum (Al) with a remainder of titanium (Ti). It will be appreciated that the spindle 44 and platform 42 are conductive to create a path for electrical energy through the grinding wheel 10 within the deposition chamber 40. The inlet of a vacuum pump 48 is in communication with the interior of the deposition chamber 40 and is utilized to draw down a deep vacuum, on the order of $10^{-5}$ to $10^{-6}$ torr. A controllable source 52 of nitrogen or other reactive gas is also provided.

The temperature of the grinding wheel 10 within the deposition chamber 40 is then raised to between 550° F. (290° C.) and 950° F. (510° C.) and an arc is struck first without the reactive gas to clean the surface of the previously deposited nickel 30A and abrasive particles 36 and then in the presence of nitrogen to achieve, through the process of arc evaporation, a coating or layer of titanium aluminum nitride or other antioxidizing material on the order of less than 1.0 micron to 5.0 microns and preferably about 1.0 to 2.0 microns. Typically, the platform 42, spindle 44 and thus the grinding wheel 10 are rotated at a speed of about 5 r.p.m. The vapor deposition process may take three to four hours or more or less depending on the desired coating or layer thickness and other process variables. FIG. 7 shows a greatly enlarged view of a portion of the exterior surface 12 of the grinding wheel 10 in cross-section which now includes an oxidation inhibiting layer 46A of titanium aluminum nitride. Known antioxidizing metals, alloys and materials may also be utilized for the layer 46A as will be readily appreciated.

Figure 5:
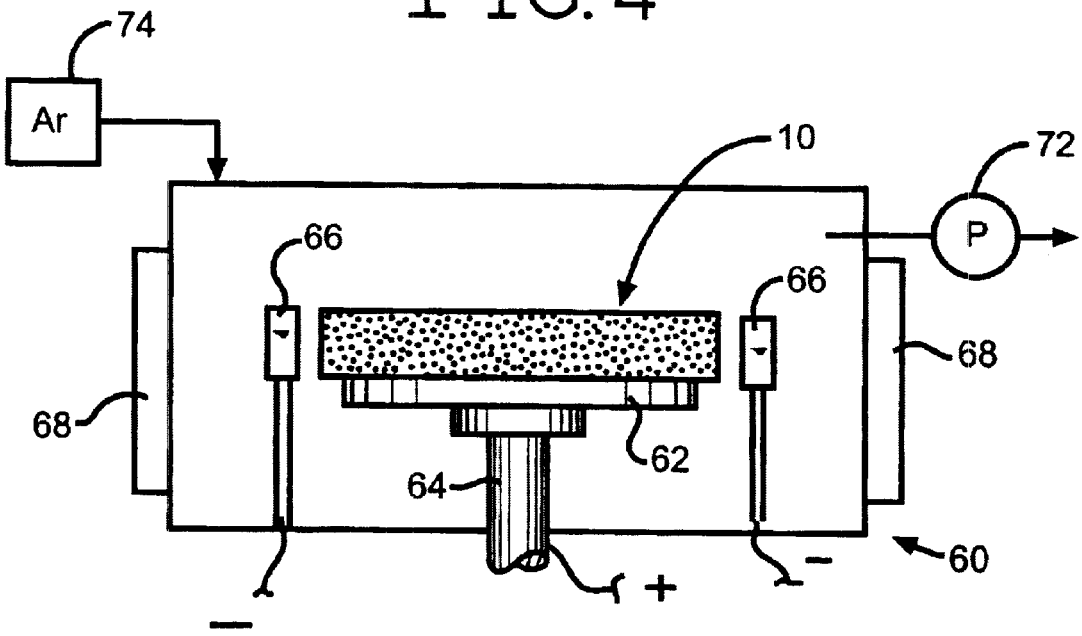
FIG. 5 is a schematic representation of a magnetron sputtering physical vapor deposition chamber which may be utilized during the manufacture of a grinding wheel according to the present invention.
Figure 8:
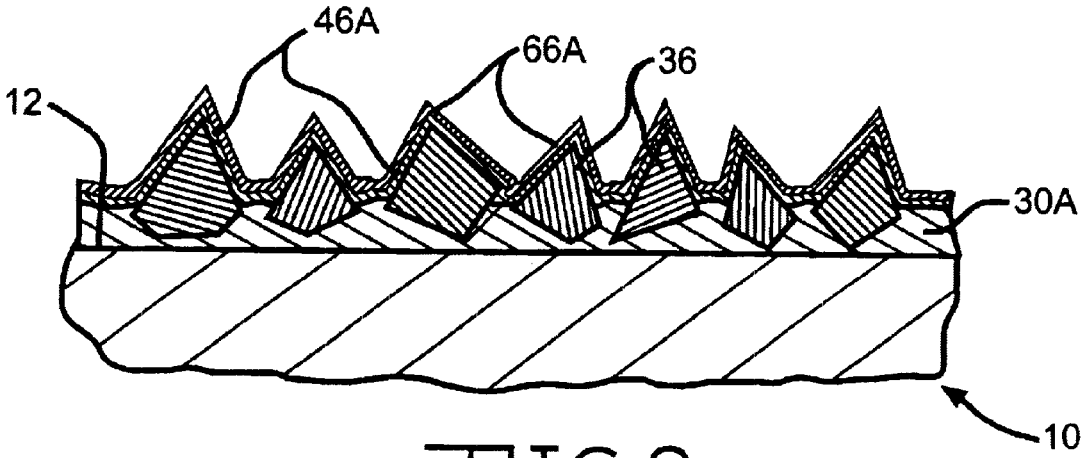
FIG. 8 is a greatly enlarged, fragmentary, sectional view of a grinding wheel having abrasive particles, a titanium aluminum nitride layer and a hard lubricant layer according to the present invention.

Referring now to FIGS. 5 and 8, a final step in the manufacturing process includes a second coating or layer applying step which preferably utilizes magnetron sputtering. As such, a vapor deposition chamber 60 is also utilized wherein a rotating platform 62 is supported upon a spindle 64 for rotation, again at speeds on the order of 5 r.p.m. One or preferably a pair of targets 66 of a hard lubricant such as molybdenum disulfide, diamond graphite, tungsten carbide carbon, carbon nitride or titanium carbon nitride are arranged proximate to and on opposite sides of the grinding wheel 10 and are electrically charged. Preferably as well, magnets 68 are utilized to focus and enhance the ion and electron flow between the targets 66 and the surface 12 of the grinding wheel 10. A vacuum pump 74 is utilized to evacuate the interior of the deposition chamber 60, again to a deep vacuum on the order of $10^{-5}$ to $10^{-6}$ torr. A gas supply of an inert gas such as argon replaces the atmosphere within the deposition chamber 60 as those familiar with conventional magnetron sputtering techniques will acknowledge. A coating or layer 66A of preferably less than about 3 microns of molybdenum disulfide or other hard lubricant as delineated above and more preferably, a coating or layer 66A of about 1 micron of molybdenum disulfide or other hard lubricant is deposited on top of the layer 46A of titanium aluminum nitride. FIG. 8 schematically illustrates on a greatly enlarged scale the final product wherein a magnetron sputtered coating or layer 66A of molybdenum disulfide or other hard lubricant overcoats the layer 46A of titanium aluminum nitride on the cubic boron nitride particles 36 secured by electroplated nickel 30A on the peripheral surface 12 of the grinding wheel 10.

Improved grinding wheel performance has been achieved by a double coating with a layer of antioxidizing titanium aluminum nitride and a layer of a hard lubricant such as molybdenum disulfide over abrasive material such as cubic boron nitride. Use of abrasive materials, particularly diamond, is expected to provide similar results. While the mechanism of the improvement is not fully understood, it is believed that the hard lubricant such as molybdenum disulfide, diamond graphite, tungsten carbide carbon, carbon nitride or tungsten carbide carbon acts as a lubricant and that such action tends to reduce clogging of the grinding wheel by reducing adherence and facilitating the release of ground material, thereby improving both grinding accuracy and wheel life.

The foregoing disclosure is the best mode devised by the inventor for practicing this invention. It is apparent, however, that products incorporating modifications and variations will be obvious to one skilled in the art of abrasives and grinding wheels. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. An improved grinding wheel comprising, in combination, a wheel having a peripheral surface, a plurality of abrasive particles secured to said peripheral surface, a layer of titanium aluminum nitride on said abrasive particles, and a layer of hard lubricant on said layer of titanium aluminum nitride.

2. The grinding wheel of claim 1 wherein said wheel includes a circular clocking groove adjacent said peripheral surface.

3. The grinding wheel of claim 1 wherein said abrasive particles are cubic boron nitride.

4. The grinding wheel of claim 1 wherein said abrasive particles are diamond.

5. The grinding wheel of claim 1 wherein said layer of titanium aluminum nitride is less than 5 microns thick.

6. The grinding wheel of claim 1 wherein said layer of hard lubricant is less than 3 microns thick.

7. The grinding wheel of claim 1 wherein said layers of titanium aluminum nitride and hard lubricant are applied by physical vapor deposition.

8. The grinding wheel of claim 1 wherein said hard lubricant is selected from the group consisting of molybdenum disulfide, diamond graphite, tungsten carbide carbon, carbon nitride, titanium carbon nitride and titanium carbide carbon.

9. The grinding of claim 1 wherein said hard lubricant is molybdenum disulfide.

10. An improved grinding wheel comprising, in combination, a circular wheel having a peripheral surface, a plurality of abrasive particles secured to said peripheral surface, a first coating of an antioxidizing material, and a second coating of a hard lubricant.

11. The grinding wheel of claim 10 wherein said circular wheel includes a circular register groove adjacent said peripheral surface.

12. The grinding wheel of claim 10 wherein said abrasive particles are cubic boron nitride.

13. The grinding wheel of claim 10 wherein said abrasive particles are diamond.

14. The grinding wheel of claim 10 wherein said coating of antioxidizing material is 5 microns thick or less.

15. The grinding wheel of claim 10 wherein said coating of hard lubricant is 3 microns thick or less.

16. The grinding wheel of claim 10 wherein said coatings are applied by physical vapor deposition.

17. The grinding wheel of claim 10 wherein said hard lubricant is selected from the group consisting of molybdenum disulfide, diamond graphite, tungsten carbide carbon, carbon nitride, titanium carbon nitride and titanium carbide carbon.

18. The grinding wheel of claim 10 wherein said hard lubricant is molybdenum disulfide.

19. The grinding wheel of claim 10 wherein said antioxidizing material is titanium aluminum nitride.

20. An improved grinding wheel comprising, in combination, a circular wheel having a peripheral surface, a plurality of cubic boron nitride particles secured to said peripheral surface, a layer of titanium aluminum nitride on said cubic boron nitride particles, and a layer of molybdenum disulfide on said layer of titanium aluminum nitride.

21. The grinding wheel of claim 20 wherein said circular wheel includes a circular clocking groove adjacent said peripheral surface.

22. The grinding wheel of claim 20 wherein said layer of titanium aluminum nitride is 5 microns thick or less.

23. The grinding wheel of claim 20 wherein said layer of molybdenum disulfide is 3 microns thick or less.

24. The grinding wheel of claim 20 wherein said layers of titanium aluminum nitride and molybdenum disulfide are applied by physical vapor deposition.

25. The grinding wheel of claim 20 wherein said plurality of cubic boron nitride particles are secured to said peripheral surface by one of electroplating, electroless plating or brazing.

* * * * *